United States Patent [19]

Taniguchi et al.

[11] Patent Number: 4,860,051

[45] Date of Patent: Aug. 22, 1989

[54] COPYING PROCESS TIMING CONTROL SYSTEM FOR ELECTROPHOTOGRAPHIC COPYING MACHINE

[75] Inventors: Akihiko Taniguchi, Nara; Yasushi Nakanishi, Yamatokoriyama, both of Japan

[73] Assignee: Sharp Kabushiki Kaisha, Osaka, Japan

[21] Appl. No.: 771,804

[22] Filed: Sep. 3, 1985

[30] Foreign Application Priority Data

Sep. 4, 1984 [JP] Japan ..... 59-187071

[51] Int. Cl.[4] ..... G03G 15/00

[52] U.S. Cl. ..... 250/231 SE; 377/17; 364/142; 355/204

[58] Field of Search ..... 255/14 R, 14 C, ; 377/3, 17; 318/602, 603, 640; 307/106; 250/206, 200, 570; 361/240; 364/142, 143

[56] References Cited

U.S. PATENT DOCUMENTS

| | | | |
|---|---|---|---|
| 3,543,110 | 4/1968 | Ruof | 361/240 X |
| 4,072,415 | 2/1978 | Inoue et al. | 355/14 R |
| 4,203,663 | 5/1980 | Ogura et al. | 355/14 C |
| 4,215,931 | 8/1980 | Tsuda et al. | 355/14 R |
| 4,270,860 | 6/1981 | Tsuda et al. | 355/14 R |
| 4,299,476 | 11/1981 | Kawatsura et al. | 355/14 C |
| 4,591,969 | 5/1986 | Bloom et al. | 318/603 X |

FOREIGN PATENT DOCUMENTS

| | | |
|---|---|---|
| 177769 | 4/1986 | European Pat. Off. . |
| 65482 | 11/1969 | German Democratic Rep. . |
| 54-96036 | 10/1979 | Japan . |

*Primary Examiner*—Fred L. Braun
*Assistant Examiner*—J. Pendegrass
*Attorney, Agent, or Firm*—Birch, Stewart, Kolasch & Birch

[57] ABSTRACT

A copying timing counting system for counting the rotation angle of a photoreceptor drum in an electrophotographic copying machine comprises a pulse generator, and a pulse counter. The pulse counter is responsive to the pulse generator for counting both the pulse rising edge and the pulse falling edge. Since the counter can count both the pulse rising edge and the pulse falling edge, the resolving power of the photoreceptor drum can be doubled as compared with the detection system of either of the pulse rising edge or the pulse falling edge taken alone.

2 Claims, 3 Drawing Sheets

| 7 | 6 | 5 | 4 | 3 | 2 | 1 | 0 |
|---|---|---|---|---|---|---|---|
| — | — | ES | MKS | MK2 | MKI | MKT | MKO |

COPYING PROCESS TIMING CONTROL SYSTEM FOR ELECTROPHOTOGRAPHIC COPYING MACHINE

BACKGROUND OF THE INVENTION

The present invention relates to a copying process timing control system useful for an electrophotographic copying machine and, more particularly, to a copying process timing control circuit for a charger and a developing device in an electrophotographic copying machine.

Conventionally, a copying timing process control system for an electrophotographic copying machine is a pulse generation device. It includes a slit disc rotated in synchronization with the rotation of a photoreceptor, and a photosensor located at the position of receiving light passing through a slit of the slit disc. The output pulse of the pulse generation device is counted by a Central Processing Unit (CPU). When it counts at a predetermined count, any related unit to that count is activated or stopped.

To increase the accuracy of the copying timing process, the resolving power of the rotation angle of the photoreceptor should be increased. For this purpose, the following proposals with the resultant disadvantages may be considered:

(1) Increasing the number of slits formed in the slit disc: It may be disadvantageous that the diameter of the slit disc will become larger, thereby resulting in an increased size of the system.

(2) Increasing of the ration number of rotations of the slit disc per rotation of the photoreceptor: It may be disadvantageous that this alternative system makes it impossible for the slit disc to be directly attached to the photoreceptor without any rotation increasing member. This system will therefore be complicated.

SUMMARY OF THE INVENTION

Accordingly, it is an object of the present invention to provide an improved copying timing control system of an electrophotographic copying machine for providing a high resolving power of the rotation angle of a photoreceptor.

It is another object of the present invention to provide an improved copying timing control circuit for an electrophotographic copying machine for accurately counting the rotation angle of a photoreceptor without changing the structure of the conventional pulse generation device.

Briefly described, in accordance with the present invention, a pulse counting switching circuit is provided for counting both the pulse rising edge and the pulse falling edge, the pulse being generated in accordance with the rotation of a photoreceptor in an electrophotographic copying machine. To alternatively count the pulse rising edge and the pulse falling edge, the switching circuit changes an enterable condition, alternatively, in response to the application of either of the pulse rising edge or the pulse falling edge.

BRIEF DESCRIPTION OF THE DRAWINGS

The present invention will become more fully understood from the detailed description given hereinbelow and the accompanying drawings which are given by way of illustration only, and thus are not limitative of the present invention and wherein.

DESCRIPTION OF THE INVENTION

Figures 1, 2:
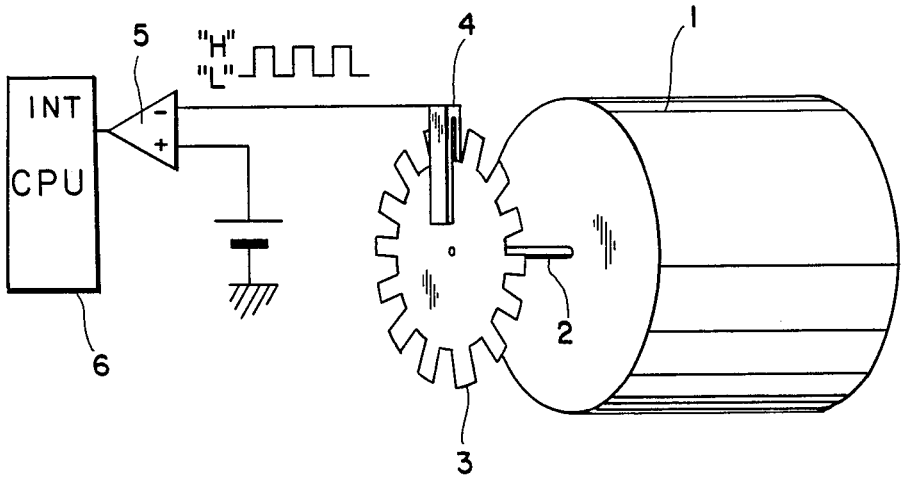
FIG. 1 is a perspective view of a copying timing control system for an electrophotographic copying machine according to the present invention.
FIG. 2 is a configuration of an interruption mask register incorporated within a Central Processing Unit (CPU) in the timing counting system of FIG. 1.

FIG. 1 is a perspective view of a copying timing control system for an electrophotographic copying machine according to the present invention.

As the copying timing control system, a photoreceptor drum 1 with its rotation axis 2 is provided with a slit disc 3. A photosensor 4 is positioned so that the optical axis of the photosensor 4 is centered at the slit portion of the slit disc 3. The output of the photosensor 4 is applied to an interruption terminal INT of a Central Processing Unit (CPU) (or processor) 6 through a comparator 5. The negative input of the comparator 5 receives the signal from the photosensor 4. The positive input of the comparator 5 is grounded through a battery. When the photosensor 4 can detect the light passing through the slit opening of the slit disc 3, the pulse rises which condition is detected by the CPU 6 to be the rising edge from "L" to "H". This is referred to as "the pulse rising edge interruption" hereinafter. Alternatively, when the photosensor 4 starts not to detect the light passing through the slit, it is treated to be the falling edge of the pulse. This is referred to as "the pulse falling edge interruption" hereinafter.

The CPU 6 may be μPD7801 produced by Nippon Electric Company (NEC), Japan.

According to the present invention, the interruption as used herein is a maskable interruption, an interruption of the type in which the CPU can prohibit or permit entering the interruption request thereto.

FIG. 2 is a construction of an interruption mask register incorporated within the CPU 6 according to the present invention.

With reference to FIG. 2, the interruption mask register includes at least 7 bits as follows:

MK0 bit: Interruption Flag (INTF) 0 mask
MKT bit: INFTT mask
MK1 bit: INFT1 mask
MK2 bit: INFT2 mask
MKS bit: INTFS mask
ES bit: to select the pulse edge for the interruption (1: the pulse rising, 0: the pulse falling edge)

When the MK2 bit is set to be 0, the interruption input to the interruption terminal INT can be permitted. Under the circumstances, the ES bit is set to be 1. This enables that when the input to the INT terminal is changed from "L" to "H", the CPU 6 can detect the occurrence of the interruption, whereby the main program is stopped and the interruption program is conducted. The main program is to execute the copying operation. The interruption program is a execute to count operation of the rolling number of the photoreceptor drum 1. The interruption program is enabled each time the pulse rising/falling interruption is applied.

Figure 3A:
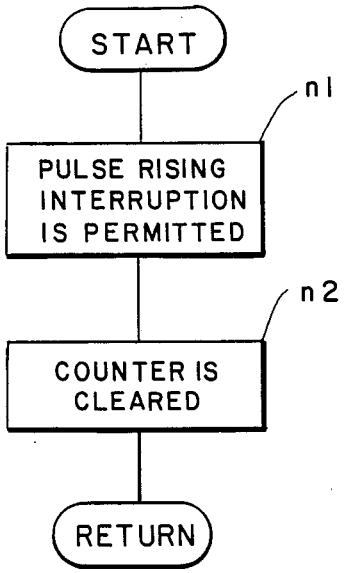
FIGS. 3(A) and 3(B) are a flow chart of the operation of the copying timing control system of the present invention.
Figure 3B:
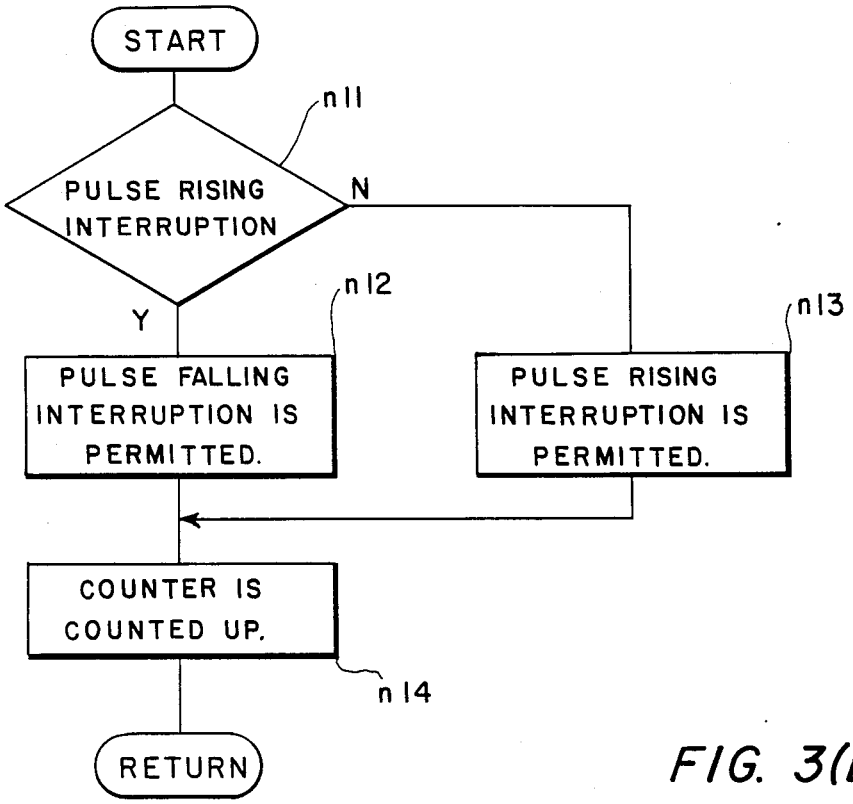

FIGS. 3(A) and 3(B) are a flow chart of the operation of the present invention.

FIG. 3(A) relates to the operation when the copying machine starts to copy any document.

Step n1: The pulse rising edge to the INT terminal is permitted.

Step n2: A counter for counting the rotation angle is cleared. The program is advanced to the main routine.

FIG. 3(B) relates to the interruption routine for the copying timing counting operation which will be conducted after the photoreceptor drum 1 starts to rotate.

Step n11: When the opening/closing edge of the slit traverses the light axis of the photosensor 4, the interruption signal is applied to the INT terminal of the CPU 6. In n11, it is detected whether the ES bit of the interruption mask register has "0" or "1". "0" corresponds to the pulse falling edge interruption while "1" corresponds to the pulse rising edge. This step is conducted for functioning as a pulse counting switching circuit of the present invention.

As stated above, when ES=1, the change from "L" to "H" enables the CPU 6 to detect that any interruption is generated.

Step n12: The pulse falling edge interruption is permitted in this step. For this purpose, the ES bit of the mask register is set to be 0, so that the change from "H" to "L" enables the CPU to detect that any interruption is generated, thereby selecting the interruption program in place of the main program being conducted.

If the operation of step n12 were absent, the counter would be placed so that it could be counted up only when the change from "L" to "H" could be treated to be any interruption. The change from "H" to "L" could not be detected by the CPU 6 and treated to be any interruption. In such a case, the double resolving power of the present invention could not be obtained.

Step n13: The pulse rising edge interruption is permitted in this step. For this purpose, the ES bit of the mask register is set to be 1.

Step n14: After the counter is counted up in this step, the main program returns.

Figure 4:
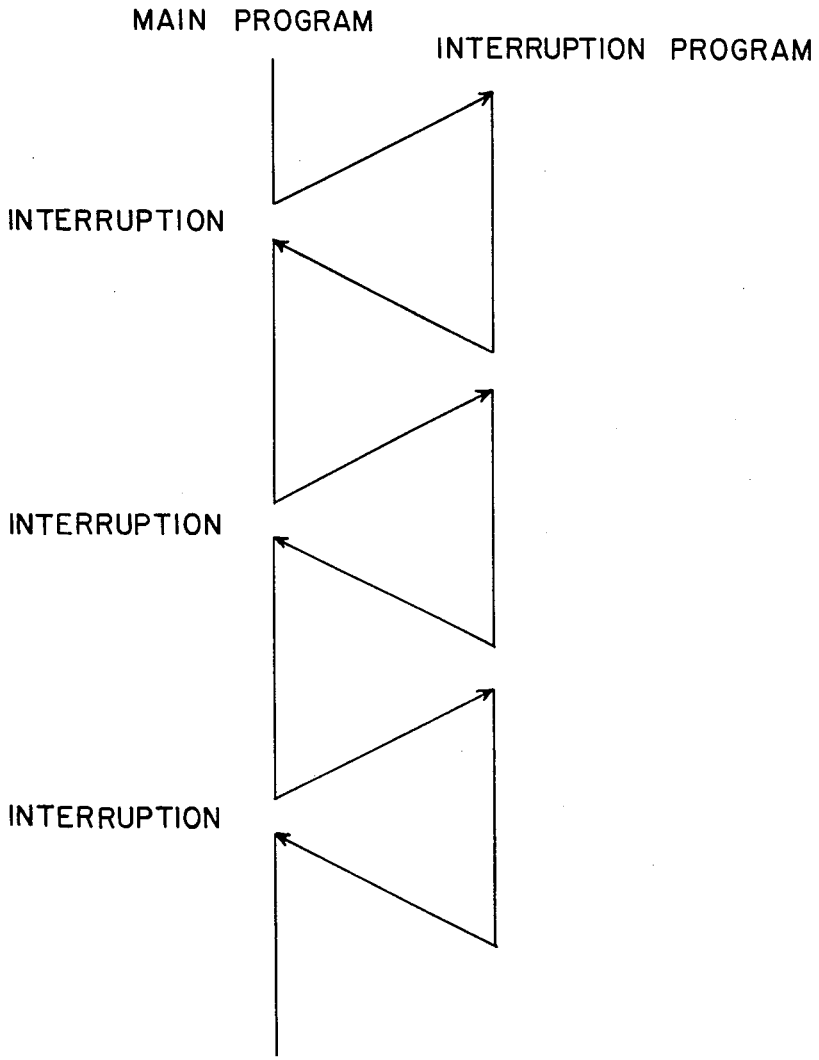
FIG. 4 is a diagram between a main program and an interruption program operated in accordance with the present invention.

FIG. 4 shows the relation between the main program and the interruption program. When the main program is conducted, any interruption is detected, so that the interruption program is selected each time. After the interruption program, the main program is selected. In the present invention, an external interruption is enabled according to the input change of the INT terminal of either the pulse falling of "H" to "L" or the pulse rising of "L" to "H".

Based on the counted and detected rotation angle of the photoreceptor drum 1, the charge and the developing device etc. are controlled.

According to the present invention, the counter in the CPU 6 can count both the pulse rising edge and the pulse falling edge, so that the resolving power of the rotation angle of the photoreceptor drum 1 can be doubled in comparison with the detection of either one of the pulse rising edge or the pulse falling edge alone.

While only certain embodiments of the present invention have been described, it will be apparent to those skilled in the art that various changes and modifications may be made therein without departing from the spirit and scope of the present invention as claimed.

What is claimed is:

1. A system for detecting the rotation angle of a photoreceptor drum in an electrophotographic copying machine, comprising:

means for generating a pulse signal in response to the rotation of said photoreceptor drum, wherein said pulse signal includes a pulse rising edge and a pulse falling edge;

counter means, responsive to generation of said pulse signal, for counting both said pulse rising edge and said pulse falling edge, control means for enabling said counter means to count both of said pulse rising edge and said pulse falling edge, said control means including a central processing unit having an interruption mask register, said interruption mask register storing a selecting bit, said central processing unit setting said selecting bit to zero to enable said counter means to count said pulse falling edge and setting said selecting bit to one to enable said counter means to count said pulse rising edge.

2. A system for detecting a rotation angle of a photoreceptor drum in an electrophotographic copying machine, comprising:

means for generating a pulse signal in response to the rotation of said photoreceptor drum, wherein said pulse signal includes a pulse rising edge and a pulse falling edge;

counter means, responsive to generation of said pulse signal, for counting both said pulse rising edge and said pulse falling edge; and control means for enabling said counter means to count both of said pulse rising edge and said pulse falling edge; said means for generating a pulse signal including, a slit disc rotatable in synchronization with said photosensitive drum, a photosensor device having its optical axis in alignment with a slit portion of said slit disc, a comparator device, and a processor, whereby light passing through and an absence of light passing through said slit portion in said slit disc is detected by said photosensor device and a signal representing this detection is applied to said processor through said comparator device to indicate said pulse rising edge and said pulse falling edge, respectively; said control means including, a central processing unit having an interruption mask register, said interruption mask register storing a selecting bit, said central processing unit setting said selecting bit to zero to enable said counter means to count said pulse falling edge and setting said selecting bit to one to enable said counter means to count said pulse rising edge.

* * * * *